United States Patent [19]

Steck et al.

[11] 4,155,748

[45] May 22, 1979

[54] MANUFACTURE OF FERROMAGNETIC METAL PARTICLES CONSISTING ESSENTIALLY OF IRON

[75] Inventors: Werner Steck; Hans H. Schneehage, both of Mutterstadt; Christof Jaeckh, Heidelberg; Werner Huebner; Manfred Ohlinger, both of Frankenthal; Werner Loeser, Ludwigshafen, all of Fed. Rep. of Germany

[73] Assignee: BASF Aktiengesellschaft, Fed. Rep. of Germany

[21] Appl. No.: 837,936

[22] Filed: Sep. 29, 1977

[30] Foreign Application Priority Data

Oct. 14, 1976 [DE] Fed. Rep. of Germany ..... 2646348

[51] Int. Cl.[2] ..... C22C 1/04

[52] U.S. Cl. ..... 75/0.5 AA; 75/0.5 BA; 148/105; 252/62.55; 252/62.56; 427/127; 428/900

[58] Field of Search ..... 75/0.5 AA, 0.5 BA; 148/105; 252/62.55, 62.56; 427/127; 428/900

[56] References Cited

U.S. PATENT DOCUMENTS

| | | | |
|---|---|---|---|
| 3,652,334 | 3/1972 | Abeck et al. | 252/62.56 |
| 4,017,303 | 4/1977 | Koester et al. | 75/0.5 AA |
| 4,050,962 | 9/1977 | Koester et al. | 148/105 |
| 4,069,073 | 1/1978 | Tadokoro et al. | 252/62.56 |

*Primary Examiner*—L. Dewayne Rutledge
*Assistant Examiner*—John P. Sheehan
*Attorney, Agent, or Firm*—Keil & Witherspoon

[57] ABSTRACT

A method of preparing acicular ferromagnetic metal particles consisting essentially of iron and suitable for magnetic recording, said particles being modified at the surface with 0.02 to 0.2% by weight of carbon and with 0.5 to 1.9% by weight of phosphorus as phosphate, by reducing a finely divided acicular iron compound, wherein there are deposited on said iron compound, prior to reduction, (a) a hydrolysis-resistant substance selected from the group consisting of oxyacids of phosphorus, their esters and inorganic salts, and (b) a compound selected from the group consisting of aliphatic monobasic, dibasic and tribasic carboxylic acids of from 1 to 6 carbon atoms.

2 Claims, No Drawings

MANUFACTURE OF FERROMAGNETIC METAL PARTICLES CONSISTING ESSENTIALLY OF IRON

BACKGROUND OF THE INVENTION

The present invention relates to a process for the manufacture of ferromagnetic metal particles, consisting essentially of iron, which are distinguished by a narrow particle size distribution coupled with a pronounced acicular shape, by reducing acicular iron oxides with gaseous reducing agents.

Because of their high saturation magnetization and the high coercive force achieved, ferromagnetic metal powders and thin metal layers are of particular interest for the manufacture of magnetic recording media. This is related to the fact that they enable the energy product and the information density to be substantially increased, so that, inter alia, narrower signal widths and higher signal amplitudes are achievable with such recording media. Thin metal layers have the further advantage over pigments that the ideal packing density of 100% can be achieved because no binder which is otherwise necessary is present. However, the cost of manufacture of the said metal layers is high, and in particular their use for magnetic recording tapes presents problems due to the mechanics of the recorder. At the optimum thickness of about 1 μm or less, the surface of the layer must be very smooth because of head/tape contact, the slightest amount of abraded material or even dust being capable of causing destruction of the layer.

It is true that when using metal powders as magnetic pigments, the mechanical properties of the recording medium can be varied within wide limits by appropriate choice of the binder system, but the metal pigments must conform to special requirements in respect of shape, size and dispersibility.

Since a high coercive force and a high residual induction are essential prerequisites for magnetic pigments intended for magnetic coatings serving as data storage memories, the magnetic pigments used must exhibit single-domain behavior and furthermore the anisotropy already present or additionally achievable by magnetic orientation in the tape should only be slightly affected by external factors, eg. temperature or mechanical stresses, ie. the small particles should exhibit shape anisotropy and preferably be of acicular shape, and should in general have a size of from $10^2$ to $10^4$ Å.

Numerous processes for the manufacture of magnetic metal particles are disclosed in the patent literature. For example, in the process of U.S. Pat. No. 2,974,104 magnetic iron particles are deposited by electroplating from an electrolyte solution onto a liquid mercury cathode. The particles must be subsequently separated from the mercury by an expensive method.

The reduction of, for example, iron salts with hydrides (J. Appl. Phys., 32, 184S, (1961)) and the vacuum vaporization of metals followed by deposition as whiskers (J. Appl. Phys., 34, 2905 (1963)) have also been disclosed, but are of no interest for industrial purposes. Further, it has been disclosed that metal powders of the above type can be manufactured by reducing finely divided acicular metal compounds, eg. oxides, with hydrogen, or some other gaseous reducing agent. The reduction must be carried out at above 350° C. if it is to take place at a rate appropriate for industrial purposes. However, this is attended by the problem of sintering of the resulting metal particles. As a result, the shape of the particles no longer conforms to that required to give the desired magnetic properties. To lower the reduction temperature, it has already been proposed to catalyze the reduction by applying silver or silver compounds to the surface of finely divided iron oxide (German Laid-Open Application DOS No. 2,014,500). Modification of the iron oxide, which is to be reduced, with tin (German Published Application DAS No. 1,907,691), with cobalt/nickel (German Published Application DAS No. 2,212,934) and with germanium, tin or aluminum (German Published Application DOS No. 1,902,270) is alleged to be similarly effective. However, if the reduction of the acicular starting compounds is catalyzed by the above metals, the resulting needles are in general far smaller than the starting product, and furthermore their length-to-width ratio is low. As a result, the end product exhibits a rather broad particle size spectrum and consequently a broad distribution of shape anisotropy. However, the literature discloses that the dependence of the coercive force and residual induction of magnetic materials on their particle size is very great when the particles are of the order of size of single-domain particles (Kneller, Ferromagnetismus, Springer-Verlag 1962, 437 et seq.). If to this are added the effects resulting from the presence of a proportion of superparamagnetic particles which may be formed as fragments when using the above method, then such magnetic pigments are highly unsuitable-for example because of their poor maximum output level-for use in the manufacture of magnetic recording media. With such heterogeneous mixtures, the magnetic field strength required to reverse the magnetization of the particles varies greatly, and the distribution of the residual magnetization as a function of the applied external field also gives a curve of low slope.

It is an object of the present invention to provide a method of producing acicular ferromagnetic metal particles which are distinguished by a narrow particle size spectrum coupled with a pronounced acicular shape and which therefore exhibit a narrow field strength distribution, a very steep residual induction curve and only slight temperature dependence of the magnetic properties.

BRIEF DESCRIPTION OF THE INVENTION

We have found that the above object can be achieved by reducing a finely divided acicular iron compound selected from the group consisting of iron oxide and iron oxide hydrate with a gaseous reducing agent at a temperature of from 230° to 500° C., there being deposited on said iron oxide or iron oxide hydrate, prior to reduction, (a) a hydrolysis-resistant substance selected from the group consisting of oxyacids of phosphorus, their esters and inorganic salts in such an amount that 0.2 to 2% by weight of phosphorus is present, and (b) a compound selected from the group consisting of aliphatic monobasic, dibasic and tribasic carboxylic acids of from 1 to 6 carbon atoms in such an amount that 0.1 to 2.1% by weight of carbon is present.

DETAILED DESCRIPTION OF THE INVENTION

For the purposes of the invention, the use of acicular goethite, lepidocrocite or of mixtures of these, with a mean particle length of from 0.1 to 2 μm, preferably from 0.2 to 1.2 μm, a length-to-width ratio of from 5:1 to 50:1 and a specific surface area $S_{N2}$ of from 33 to 80

$m^2$, preferably from 38 to 75 $m^2$, has proved particularly advantageous. The dehydrated products obtained from the said hydrated iron(III) oxides may also be used, the dehydration advantageously being carried out in air at from 200° to 600° C.

Hydrolysis-resistant oxyacids of phosphorus, their salts or esters and aliphatic monobasic or polybasic carboxylic acids are now applied to the said iron oxides by the process of the invention.

Examples of suitable hydrolysis-resistant compounds are phosphoric acid, soluble monophosphates, diphosphates or triphosphates, eg. potassium dihydrogen phosphate, ammonium dihydrogen phosphate, disodium orthophosphate or dilithium orthophosphate and trisodium phosphate, sodium pyrophosphate, and metaphosphates, eg. sodium metaphosphate. The compounds may be employed singly or as mixtures with one another. The esters of phosphoric acid with aliphatic monoalcohols of 1 to 6 carbon atoms, eg. the tert.-butyl ester of phosphoric acid, may be employed with advantage. For the purposes of the invention, carboxylic acids are saturated or unsaturated aliphatic carboxylic acids of up to 6 carbon atoms and having up to 3 acid groups, in which acids one or more hydrogen atoms of the aliphatic chain may be substituted by hydroxyl or amino. Particularly suitable acids are oxalic acid and hydroxydicarboxylic and hydroxytricarboxylic acids, eg. tartaric acid and citric acid.

To carry out the treatment of the iron oxides, the latter are suspended, by intensive stirring, in water or in water-soluble organic solvents, preferably lower aliphatic alcohols, or mixtures of these organic solvents with water, but preferably in water alone. The appropriate phosphorus compound and the carboxylic acid are added to this suspension of the oxide particles. The sequence of addition is immaterial and the additives may even be dissolved in the solvent before suspending the iron oxide. After the addition, stirring is continued for some time, advantageously for from 10 to 60 minutes, to ensure uniform distribution, and the treated oxide is then filtered off and dried at up to 185° C. in air or under reduced pressure.

The substances applied to the iron oxide in accordance with the process of the invention are added to the suspension in such on amount that after the treatment there are present, on the surface of the dried product, hydrolysis-resistant oxyacids of phosphorus, their salts or esters in an amount corresponding to from 0.1 to 2, preferably from 0.2 to 1.8, percent by weight of phosphorus, and aliphatic carboxylic acids in an amount corresponding to from 0.1 to 1.2, preferably from 0.2 to 1, percent by weight of carbon, each based on the iron oxide. The concentration required to achieve this may, after selection of the compounds to be used, easily be established by a few experiments and analytical determinations.

According to the process of the invention, the acicular oxide treated in this way is reduced in the conventional manner to the metal by passing a gaseous reducing agent, preferably hydrogen, over the oxidic material at up to 500° C., preferably at from 230° to 450° C.

According to the prior art, a satisfactory degree of reduction of untreated metal oxides at below 300° C. could only be achieved after a long reduction period. It is true that the rate of reduction increased between 300° and 400° C., but this was accompanied by increasing sintering of the iron pigment. It is also true that surface modification with catalytically active metals did result in higher rates of reaction and a higher coercive force, but the other magnetic properties and pigment properties did not conform to the high standards which magnetic pigments for magnetic recording media have to meet.

Compared to the prior art, the metal particles of the invention are distinguished by greatly improved coercive force and residual induction. This result is only achievable if, in accordance with the process of the invention, both components, ie. the phosphate component and the carboxylic acid component, are present on the surface of the iron oxide to be reduced, and hence the metal particles formed by reduction have the stated content of phosphorus in the form of phosphate, and of carbon. Treating the particles with only one component does not simultaneously improve the coercive force and the residual induction.

In addition to a high coercive force Hc and a high residual induction, the remanence coercivity $H_R$ is an important assessment parameter. In d.c. magnetization, half (by volume) of the particles are reverse-magnetized at field strength $H_R$. Accordingly, $H_R$ is a characteristic parameter for recording processes, which in particular determines the bias setting for magnetic recording. The more non-uniform the remanence coercivity of the individual magnetic particles in the recording layer is, the broader is the distribution of the magnetic fields which can reverse the magnetization of a defined volume of the recording layer. This is particularly noticeable if, because of the high recording densities or short wavelengths, the boundary zone between regions of opposite magnetization should be as narrow as possible. To characterize the distribution of the field strengths of the individual particles, the value $h_5$ for the total width of the residual induction curve and $h_{25}$ for the slope of the residual induction curve is determined from the d.c. demagnetization curve. These values are determined from the equations $$h_5 = H_{95} - H_5/H_R$$

and $$h_{25} = H_{75} - H_{25}/H_R$$

The subscript following the H indicates what percentage of the particles has in each case been reverse-magnetized.

Typical $h_5/h_{25}$ values are 1.5/0.6 for gamma-iron(III) oxide powders and chromium dioxide powders and 1.0/0.3 for the magnetic tapes produced therewith. Magnetic metal particles of the prior art show higher values, which are from 1.8 to 2.0/0.6 and accordingly indicate a broader field strength distribution.

By comparison, the metal particles according to the invention exhibit surprisingly advantageous properties.

After the reduction, which is virtually complete even below 300° C., it is found that the acicular shape of the starting oxides has undergone no significant change. Iron needles with a length of from 0.1 to 0.6 μm and a length-to-width ratio of from 10 to 25:1 are an example of the products of the process of the invention.

The $h_5/h_{25}$ values of metal particles manufactured in accordance with the invention are 1.6/0.55, ranging to 1.45/0.48. Such magnetic metal powders contain, in spite of the process of manufacture by reduction of oxide powders, acicular particles of uniform shape which, in addition to having the advantageous magnetic properties of ferromagnetic small particles exhibiting shape anisotropy, possess the narrow field strength distribution required for high recording densities and frequencies.

The Examples which follow illustrate the invention.

The coercive force $H_c$ [kiloamps/m], the specific remanence $M_R/\rho$[nTm$^3$/g] and the specific saturation magnetization $M_S/\rho$[nTm$^3$/g] of the powder samples were measured in a vibrating sample magnetometer at a field strength of 160 kiloamps/m. The coercive force $H_c$ is calculated on the basis of a tap density of 1.6 g/cm$^3$, using the equation:

$$H_{c\rho=1.6}=H_c x 6/7.6-\rho$$

EXAMPLE 1

50 g of geothite having a particle length of 0.82 μm and a length-to-width ratio of 35:1 are suspended in 750 ml of water, with intensive stirring. 1 g of oxalic acid ($C_2H_4O_4.2H_2O$) followed by 0.35 ml of 85% strength phosphoric acid are added to this suspension. After continuing the stirring for 10 minutes, the solid is filtered off and the filter cake is dried in air at 120° C. Reduction of the goethite, treated in this way, for 8 hours, at 310° C. in a 30 l of hydrogen per hour gives an acicular iron powder.

The magnetic properties of the resulting iron powder, and the analytical values are given in Table 1.

EXAMPLE 2

The procedure described in Example 1 is followed except that phosphoric acid and oxalic acid are added simultaneously to the suspension.

The magnetic properties of the resulting iron powder, and the analytical values, are shown in Table 1.

COMPARATIVE EXPERIMENT 1

50 g of geothite are suspended in 750 ml of water as described in Example 1, and the procedure of Example 1 is then continued (A) without additives, (B) after adding 1 g of oxalic acid, or (C) after adding 0.35 ml of 85% strength phosphoric acid.

The magnetic properties of the iron powders obtained in these Comparative Experiments, and the analytical values, are also shown in Table 1.

Table 1

| | Content of | | | $H_c$ at | | | |
|---|---|---|---|---|---|---|---|
| | % $PO_4$ | % C | $H_C$ | $\rho$ = 1.6 | $M_S/\rho$ | $M_R\rho$ | $M_R/M_S$* |
| Example 1 | 1.4 | 0.04 | 77.6 | 66.8 | 154 | 84 | 0.55 |
| Example 2 | 1.2 | 0.08 | 83.9 | 71.0 | 146 | 80 | 0.55 |
| Comparative Experiment 1A | 0 | 0 | 73.3 | 62.9 | 130 | 75 | 0.587 |
| Comparative Experiment 1B | 1.3 | 0 | 75.5 | 66.5 | 131 | 66 | 0.50 |
| Comparative Experiment 1C | 0 | 0.06 | 64.4 | 58.9 | 142 | 81 | 0.57 |

*$M_R/M_S$ = relative remanence

In 3 parallel batches A, B and C, 50 g portions of alpha-FeOOH having an average needle length of 0.51 μm and a length-to-width ratio of 28.3:1 are suspended in 750 ml of water.

Batch A is filtered off as in Example 1 and the filter cake is dried at 120° C. After reduction for 8 hours with 30 1/h of hydrogen at 350° C., an acicular iron powder is obtained.

0.35 ml of 85% strength $H_3PO_4$ are added to Batch B and the reduction is carried out at 350° C.

0.35 ml of 85% strength $H_3PO_4$ and 1 g of $C_2H_2O_4.2H_2O$ are added simultaneously to Batch C. The reduction is carried out at 350° C.

The magnetic properties of the metal pigments are summarized in Table 2.

Table 2

| Dispersion | Content of % $PO_4$ | Content of % C | $H_C$ | $H_C$ at $\rho$ = 1.6 | $M_S/\rho$ | $M_R/\rho$ | $M_R/M_S$ |
|---|---|---|---|---|---|---|---|
| A | — | — | 73.0 | 62.5 | 127 | 70 | 0.55 |
| B | 1.8 | — | 77.0 | 66.9 | 121 | 61 | 0.50 |
| C | 1.3 | 0.08 | 82.2 | 71.6 | 133 | 72 | 0.54 |

EXAMPLE 4

50 g of alpha-FeOOH from Example 1 are suspended in 1,000 ml of ethanol and 0.35 ml of 85% strength $H_3PO_4$ and 0.425 ml of formic acid are added. Reduction at 310° C. gives an iron pigment containing 1.6% of phosphate and 0.13% of carbon, and having a coercive force $H_c$ ($\rho$=1.6), at 160 kiloamps, of 74.6 kiloamps/m and a specific remanence $M_R/\rho$ of 63 nTm$^3$/g.

EXAMPLE 5

50 g of alpha-FeOOH from Example 1 are suspended in 1,000 ml of ethanol and 0.35 ml of 85% strength $H_3PO_4$ and 0.5 g of citric acid are added. Reduction of 350° C. gives an iron pigment containing 1.3% of phosphate and 0.03% of carbon, and having a coercive force $H_c$ ($\rho$=1.6), at 160 kiloamps, of 76.7 kiloamps/m and a specific remanence of 65 nTm$^3$/g.

EXAMPLE 6

50 g of alpha-FeOOH from Example 1 are suspended in 1,000 ml of ethanol and 0.5 g of $Na_3PO_4$ and 0.5 g of oxalic acid ($C_2H_4O_4.2H_2O$) are added. Reduction at 310° C. gives an iron pigment containing 0.36% of phosphate and 0.08% of carbon, and having a coercive force $H_c$ ($\rho$=1.6), at 160 kiloamps, of 71.8 kiloamps/m and a specific remanence of 94 nTm$^3$/g.

EXAMPLE 7

50 g of alpha-FeOOH having an average needle length of 0.65 μm and a length-to-width ratio of 33.9:1 are suspended in 750 ml of $H_2O$ and 0.35 ml of $H_3PO_4$ and 0.5 g of oxalic acid ($C_2H_4O_4.2H_2O$) are added. Reduction at 350° gives an iron pigment containing 1.7% of phosphate and 0.1% of carbon, and having a coercive force $H_c$ ($\rho$=1.6), at 160 kiloamps, of 72.3 kiloamps/m and a specific remanence of 71 nTm$^3$/g.

We claim:

1. A method of preparing acicular ferromagnetic metal particles consisting essentially of iron and suitable for magnetic recording, said particles being modified at the surface with 0.02 to 0.2% by weight of carbon and with 0.5 to 1.9% by weight of phosphorus as phosphate, by reducing a finely divided acicular iron compound selected from the group consisting of iron oxide and iron oxide hydrate with a gaseous reducing agent at a temperature of from 230° to 500° C., wherein there are deposited on said iron oxide or iron oxide hydrate, prior to reduction, (a) a hydrolysis-resistant substance selected from the group consisting of oxyacids of phosphorus, their esters and inorganic salts in such an amount that 0.2 to 2% by weight of phosphorus is present, and (b) a compound selected from the group consisting of aliphatic monobasic, dibasic and tribasic carboxylic acids of from 1 to 6 carbon atoms in such an amount that 0.1 to 1.2% by weight of carbon is present.

2. A method of preparing acicular ferromagnetic iron metal particles, said particles being modified at the surface with 0.02 to 0.2% by weight of carbon and with 0.5 to 1.9% by weight of phosphorus as phosphate, which comprises the steps of (a) dispersing acicular iron oxide hydrate in a solution of a hydrolysis-resistant substance selected from the group consisting of oxyacids of phosphorus, their esters and inorganic salts, and a compound selected from the group consisting of aliphatic, monobasic and tribasic carboxylic acids of from 1 to 6 carbon atoms;

(b) removing the solvent by filtration and heating, whereby said hydrolysis-resistant substance based on oxyacids of phosphorus is applied to said iron oxide hydrate in such an amount that from 0.2 to 2% by weight of phosphorus is present, and said carboxylic acid is applied to said iron oxide hydrate in such an amount that from 0.1 to 1.2% by weight of carbon is present, and (c) reducing the so-treated acicular iron oxide hydrate by passing gaseous hydrogen at a temperature of from 230° to 450° over said treated iron oxide hydrate to form acicular iron metal particles retaining the acicular shape of the acicular iron oxide hydrate starting material.

* * * * *